US009598864B1

(12) United States Patent
Hulka et al.

(10) Patent No.: US 9,598,864 B1
(45) Date of Patent: Mar. 21, 2017

(54) SUSPENSION SYSTEM FOR FLAT DRYWALL CEILING

(71) Applicant: USG Interiors, LLC, Chicago, IL (US)

(72) Inventors: Samuel D. Hulka, Mount Prospect, IL (US); James J. Lehane, McHenry, IL (US); Peder J. Gulbrandsen, Aurora, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 15/097,334

(22) Filed: Apr. 13, 2016

(51) Int. Cl.
*E04B 9/00* (2006.01)
*E04B 9/06* (2006.01)
*E04B 9/22* (2006.01)

(52) U.S. Cl.
CPC ..... *E04B 9/067* (2013.01); *E04B 9/225* (2013.01)

(58) Field of Classification Search
CPC ..... E04B 9/067; E04B 9/225
USPC ..... 52/506.07
See application file for complete search history.

(56) References Cited

U.S. PATENT DOCUMENTS 2,814,080 A * 11/1957 Tvorik ..... E04F 13/042 52/417
3,675,383 A 7/1972 Paoletti
5,799,458 A 9/1998 Ferguson
7,578,107 B2 8/2009 Platt
8,770,345 B2 7/2014 Dugan et al.
8,898,986 B1 12/2014 Underkofler et al.
2003/0154686 A1* 8/2003 Platt ..... E04B 9/061 52/506.05
2005/0193668 A1* 9/2005 Hamilton ..... E04F 13/042 52/371
2007/0277467 A1* 12/2007 Platt ..... B21D 47/01 52/506.07
2008/0245018 A1* 10/2008 Miller ..... E04B 9/061 52/506.07
2008/0245026 A1* 10/2008 Hamilton ..... E04F 13/04 52/698
2010/0257807 A1* 10/2010 Raheel ..... E04B 9/245 52/506.07

* cited by examiner

*Primary Examiner* — Beth Stephan
(74) *Attorney, Agent, or Firm* — Pearne & Gordon LLP

(57) ABSTRACT

A suspended drywall ceiling grid construction comprising a plurality of uniformly spaced parallel sheet metal support bars, a plurality of spaced grid tees carried on lower sides of the support bars, the support bars having regularly spaced centers for engaging and supporting grid tee reinforcing bulbs, the centers and grid tees being constructed and arranged to present lower faces of flanges of the grid tees in a common plane, the support bars having intermediate centers between said regularly spaced centers for receiving butt joint tees, the intermediate centers and butt joint tees being constructed and arranged to present lower faces of flanges of the butt joint tees in a plane a predetermined distance above the common plane.

7 Claims, 4 Drawing Sheets

SUSPENSION SYSTEM FOR FLAT DRYWALL CEILING

BACKGROUND OF THE INVENTION

The invention relates to drywall ceiling construction and, in particular, to a construction in which taped end joints between drywall sheets are easily concealed.

PRIOR ART

Drywall sheets are manufactured as rectangular panels with a standard width of four feet and with a regular series of lengths of 8, 10, 12, 14 and 16 feet or metric industry equivalents. The long edges or margins of the sheets are tapered at their face side. The tapered margins are provided to enable tape and joint compound to be received in a joint above the face plane of the ceiling being constructed. The ends of the sheets are not tapered because of limitations of the production process used to make the sheets. Joints between the ends of drywall sheets, sometimes called butt joints, are difficult to conceal because the thickness of the joint tape intrudes into the plane of the face of the ceiling. The butt joints in ceilings are particularly difficult to conceal, in part, because they are often highlighted by indirect lighting. Frequently, a drywall ceiling is heavily textured to mask the presence of butt joints. Texturing of a ceiling is not practical where a relatively smooth surface is specified and/or where the drywall has acoustical properties derived from a porous face. U.S. Pat. Nos. 7,578,107 and 8,898,986 illustrate examples of sheet metal strips or bars that can be used to suspend transverse sheet metal drywall grid tees. The strips or bars have regular keyhole-like slots along their length that capture the upper reinforcing bulbs of the tees. Drywall sheets are conventionally attached to the lower flange faces of the suspended grid tees with self-drilling screws.

SUMMARY OF THE INVENTION

The invention provides a grid structure for a suspended drywall ceiling that facilitates concealment of drywall butt joints. In the inventive structure, spaced parallel support bars carry transverse grid tees on regularly spaced centers. Drywall sheets are fastened to the lower faces of the grid tees. The grid is laid out so that certain grid tees will overlie the butt joints of the drywall panels. The support bars and the butt joint tees are configured so that the lower flange faces of the butt joint tees are slightly elevated from a plane established by the regularly spaced grid tees. The differential level of the butt tee flanges causes the butt ends of the drywall sheets to be drawn up by bending away from the face plane of the ceiling represented by the major surface areas of the drywall sheets. As a result, local areas of the drywall sheet butt ends provide a recess for completely receiving the thickness of joint tape and any joint compound necessary to conceal the tape.

Where, as disclosed, the butt joint tees are situated midway between the regular grid tee centers, the bending deformation of the drywall sheets is localized so as to be spanned by a taping trowel of limited width and to require only a relatively narrow band of joint compound to conceal the joint.

In the preferred embodiment, the differential height between the regularly spaced grid tees and the butt joint tees is obtained by using vertically shorter grid tees at the butt joints. In this instance, the support bars hold the upper portions of all of the grid tees at the same level so that the vertically shorter grid tees present their lower flanges slightly above the regularly spaced taller grid tees.

DESCRIPTION OF THE PREFERRED EMBODIMENT

Figure 1:
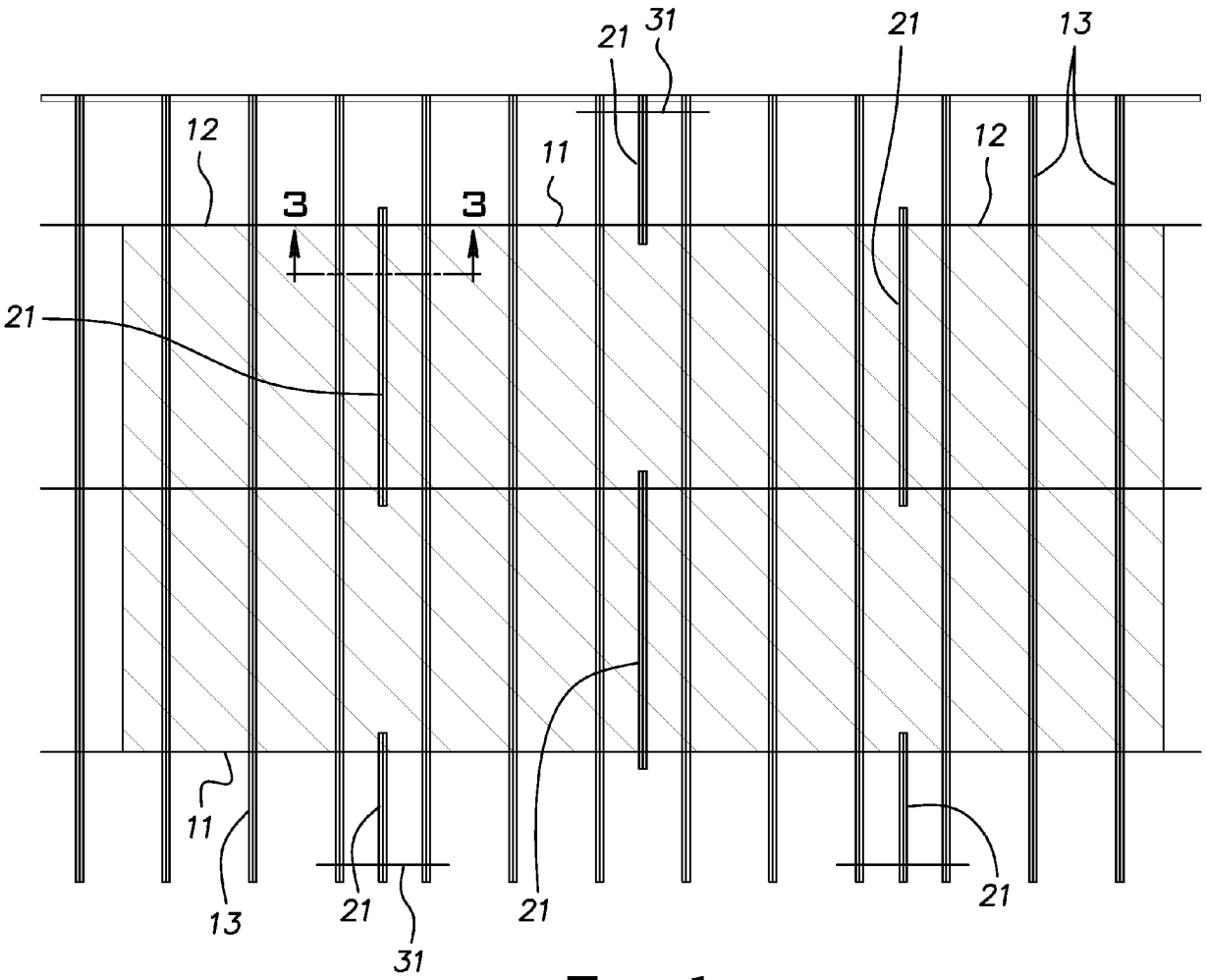
FIG. 1 is a schematic plan view of a suspended ceiling embodying the invention.

A suspended ceiling 10 is shown with full and half drywall sheets 11, 12, respectively, hung on conventional sheet metal grid tees 13. The grid tees are suspended from sheet metal bars or strips 14 of, for example, roll formed 0.032/0.036 inch gauge G40 hot dipped galvanized (HDG) steel stock. The bars or strips 14 are identical in detail and are typically suspended by wires 15 from superstructure such as floor or roof joists. Margins of the ceiling area illustrated in FIG. 1 are incomplete. Partial drywall sheets remain to be fitted and hung in these areas.

Figure 2:
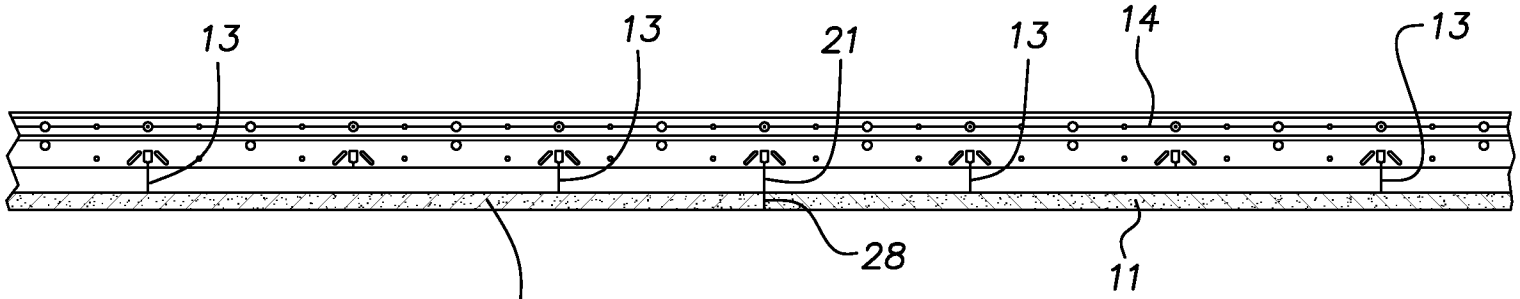
FIG. 2 is a fragmentary cross-sectional view taken in a vertical plane of the ceiling of FIG. 1.
Figure 3:
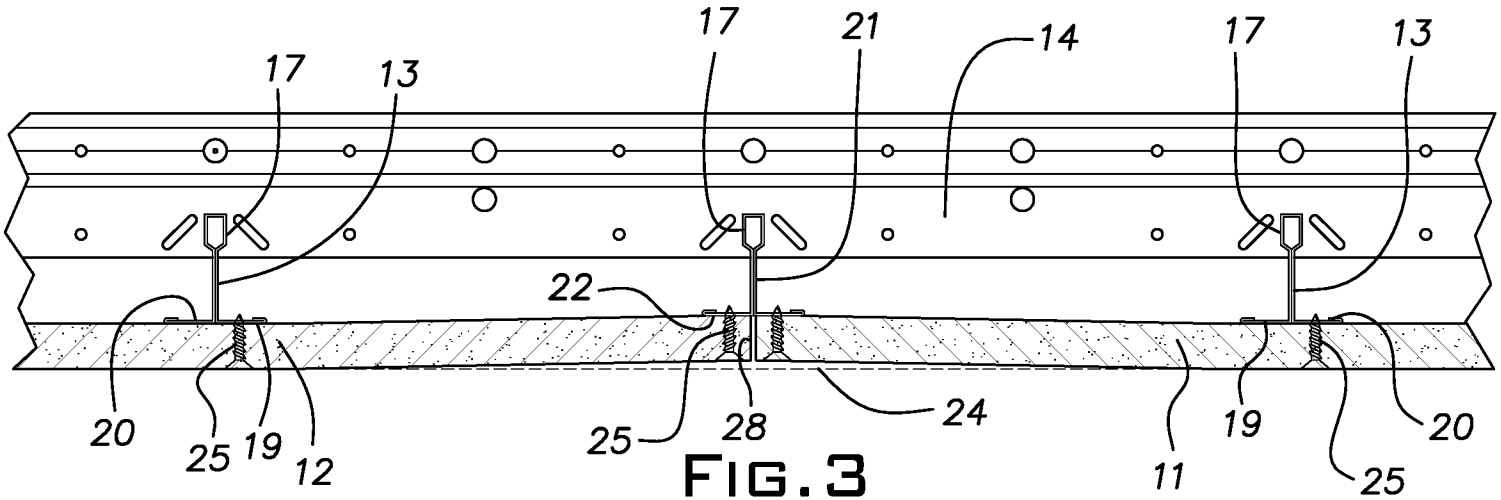
FIG. 3 is an enlarged fragmentary cross-sectional view of the ceiling taken at the plane 3-3 indicated in FIG. 1 where a butt joint, prior to taping, is illustrated.
Figure 4:
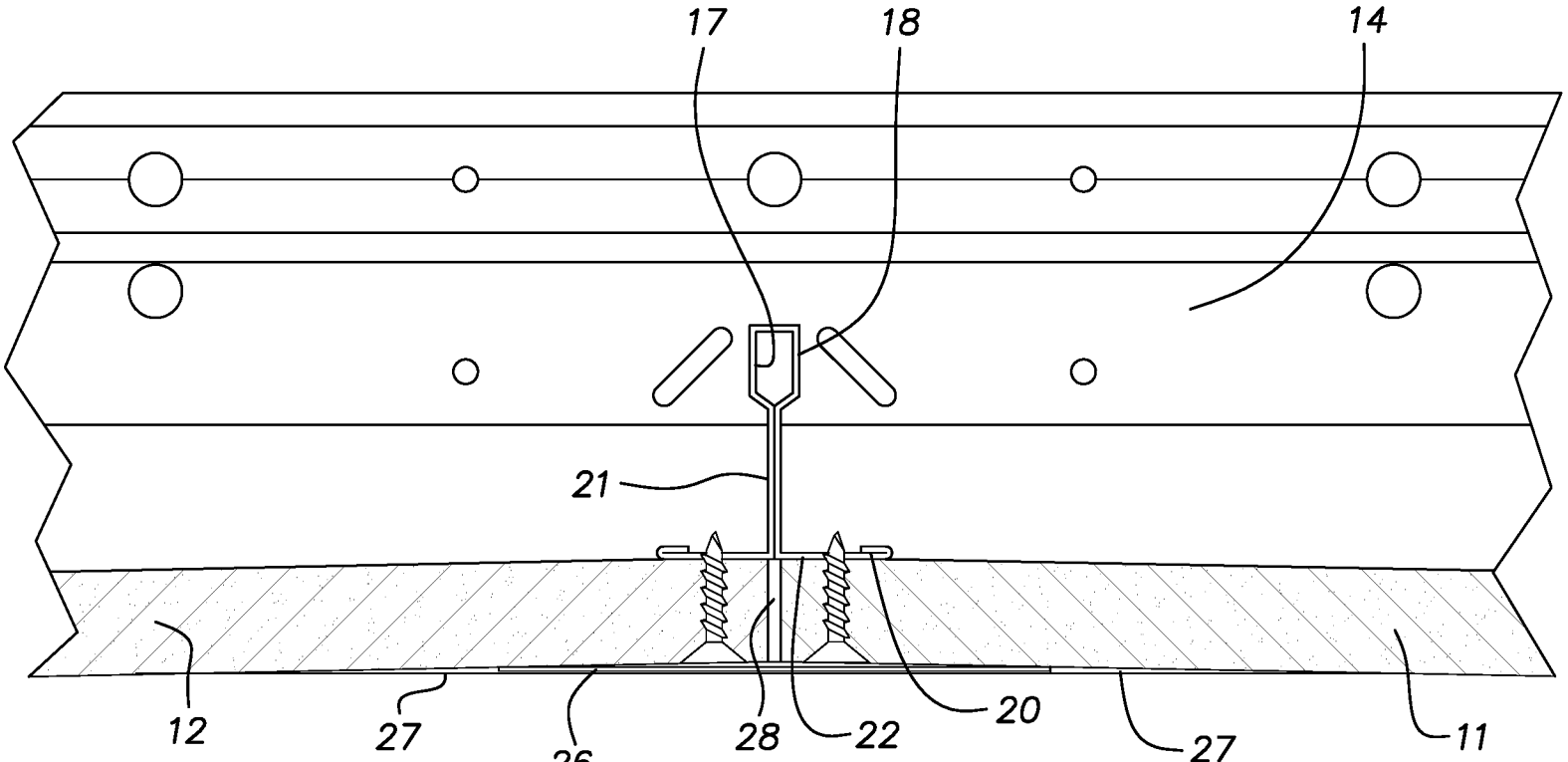
FIG. 4 is a further enlarged view of the butt joint of FIG. 3 after taping.
Figure 5:
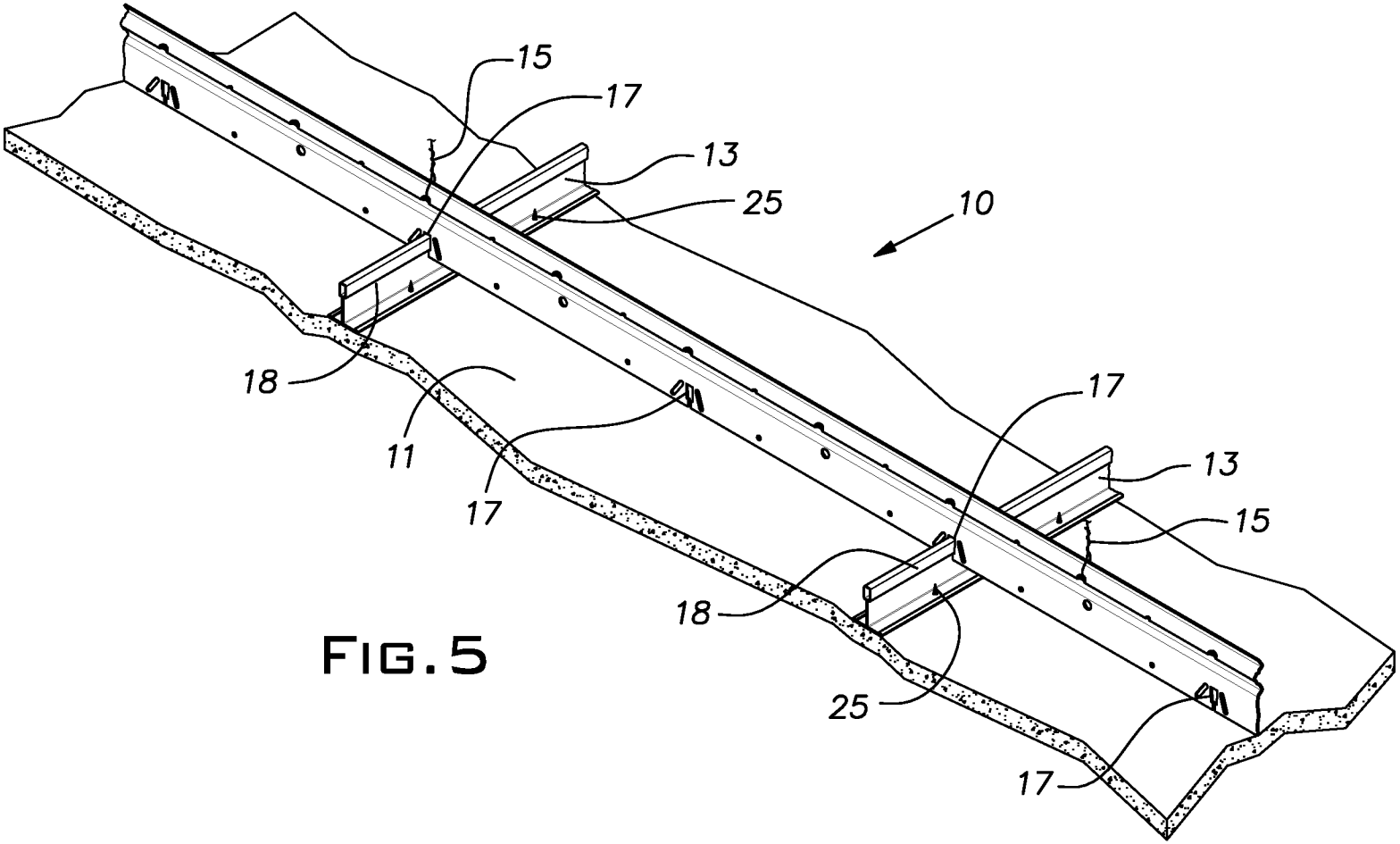
FIG. 5 is a fragmentary perspective view from above of the ceiling of FIG. 1.

With reference to FIGS. 2-4, a bar 14 includes keyhole-like slots 17 on 8 inch centers along their lengths and adjacent their lower edges. Dimensions used in this disclosure are to be understood to include standard industry metric equivalents. The slots 17 are proportioned to receive and vertically support upper reinforcing bulbs 18 that exist on conventional drywall grid tees 13. FIG. 5 illustrates the relationship of the bars 14, tees 13, and drywall 11. The bars 14 are suspended, ordinarily in a horizontal plane, in parallel rows on 4 foot centers, for example. The bars 14 are aligned so that their slots 17 support grid tees 13 transversely to the bars.

The slots 17, as seen most clearly in FIGS. 3 and 4, have a configuration that engages the underside of a grid tee reinforcing bulb 18 to support the tee 13. The bar area adjacent and below a slot 17 can be bent out of a plane of the lower part of the bar to permit a tee bulb 18 to be moved vertically, that is, laterally of the grid tee, rather than longitudinally into a slot 17. The bent area can then be bent back into the plane of the bar bottom to capture the tee bulb in the slot.

Tees 13 are regularly assembled in alternate slots 17 so that they are on 16 inch centers. Tees 13 assembled on the 16 inch centers have a uniform profile and a height of, for example, 1⅝ inch. Drywall sheets 11, 12 are attached to lower faces 19 of flanges 20 of the tees 13 with self-drilling screws 25 in a known manner. The arrangement of the drywall sheets 11, 12 in FIG. 1 follows a practice of staggering the end or butt joints of the sheets to minimize variations in appearance that could occur at a joint. Butt joints 28, in the illustrated case, are located off the 16 inch centers of the regularly spaced grid tees 13 leaving them spaced 8 inches from these regular tees. Tees 21 at the butt joints 28 have their lower flange faces 22 spaced a small distance, for example, ⅛ inch higher than a horizontal plane in which the lower faces 19 of the regular tee flanges 20 exist. This can be accomplished by using drywall grid tees 21 that are vertically shorter than the regularly spaced grid tees 13, it being understood that both the vertically short and the taller tees have the same reinforcing bulb profile.

The mid-sections of FIGS. 2 and 3 illustrate the condition where an off-center vertically short tee 21 is at a butt joint between the ends of two drywall sheets 11. Screws 25 driven through the non-tapered ends of the sheets 11 draw the sheets up above a face plane 24 of the ceiling 10 indicated by the broken line in FIG. 3. The upward bending of the sheet ends, imposed to contact the vertically short tees 21, leaves space for joint tape 26 and a layer of joint compound 27. Typically, the curvature imposed on each sheet end is negligible at the adjacent taller grid tees 13. As a result, the width of the space above the plane 24 across both abutted sheet ends will be easily bridged by a 12 inch trowel. When the space above the plane 24 is filled with joint compound and the joint and sheets 11, 12 are painted, the joint will be imperceptible.

Preferably, the vertically shorter tees 21 are longer than the width of a sheet 11, 12 and the spacing between a pair of adjacent bars 14 so that the ends of the short tees are cantilevered over adjacent sheets 11, 12. This extension of the vertically short tees 21 allows an underlying local area of the adjacent sheet 11, 12 to be drawn upwardly from the plane 24 by one or more screws. This local deformation assures that the end of a joint tape 26 across a butt joint 28 can be concealed by joint compound even if it extends horizontally beyond the butted ends.

Referring to FIG. 1, at marginal areas of the ceiling 10, such as at a wall or open end of an island or peninsula, short lengths 31 of stock of the bar 14 can be used as a bridge between an adjacent pair of tall grid tees 13. In this bootstrap arrangement, distal outlying ends of the adjacent tall tees 13 support an outlying end of a butt joint vertically short tee 21 through the short length of bar stock 31. The wall angle is eliminated between the adjacent pair of tall grid tees 13 to provide clearance for the upwardly bent end areas of the sheets 11 at the butt joint. The inward end of the butt joint tee 21 is supported in a continuous bar 14 or in some instances by another short length of stock of the bar 14 in a similar bootstrap arrangement.

The invention is particularly useful where a smooth finish is desired on a drywall ceiling and the butt joints of the ceiling cannot be concealed by texturing the ceiling. An example of an application of the invention is in acoustical monolithic drywall ceilings such as disclosed in U.S. Pat. No. 8,770,345.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A suspended drywall ceiling grid construction comprising a plurality of uniformly spaced parallel sheet metal support bars, a plurality of spaced grid tees carried on lower sides of the support bars, the support bars having regularly spaced centers engaging and supporting reinforcing bulbs of the grid tees, the centers and grid tees being constructed and arranged to support lower faces of flanges of the grid tees in a common plane below the support bars, the support bars having intermediate centers between said regularly spaced centers for receiving butt joint tees, the intermediate centers and butt joint tees being constructed and arranged to support lower faces of flanges of the butt joint tees closer to the support bars than the spacing of the grid tee flange lower faces from the support bars.

2. A construction as set forth in claim 1, wherein the intermediate centers are disposed midway between adjacent pairs of the regularly spaced centers.

3. A construction as set forth in claim 1, wherein the regularly spaced centers and the intermediate centers are identical and the butt joint grid tees are vertically shorter than the regularly spaced grid tees.

4. A construction as set forth in claim 1, wherein the support bar centers include keyhole slots proportioned to receive the reinforcing bulbs on upper parts of the grid tees.

5. A construction as set forth in claim 1, wherein the butt joint grid tees are longer than the spacing between adjacent bars and have cantilevered end portions with a length less than the spacing between adjacent bars.

6. A construction as set forth in claim 5, wherein a marginal area of the grid at which the spacing from a proximal bar to a ceiling edge is less than the spacing between bars, a segment of a bar bridges the space between regularly spaced grid tees at which a butt joint between drywall sheets is planned and is adjacent the edge, the bar segment having a center receiving a butt joint grid tee.

7. A method for taping and finishing butt joints of a drywall ceiling by constructing a grid of sheet metal hanger bars and sheet metal grid tees suspended transversely below and from the hanger bars, arranging the grid tees on the hanger bars at regular centers, arranging butt joint tees between pairs of adjacent grid tees at the regular centers, the butt joint tees having drywall sheet receiving flanges elevated above flanges of the grid tees, hanging sheets of drywall on the grid by screws driven through the sheets and the flanges, butt ends of the sheets being aligned under and screwed to butt joint tees whereby the butt ends of the sheets are drawn up above a plane in which major face areas of the sheets underlying the regularly spaced grid tees lie, filling a zone underlying the butt ends of the sheets and above the plane of the major face areas with joint tape and joint compound.

* * * * *